US010898051B2

(12) United States Patent
Rehm

(10) Patent No.: US 10,898,051 B2
(45) Date of Patent: Jan. 26, 2021

(54) WATER-CONDUCTING DOMESTIC APPLIANCE AND METHOD FOR OPERATING A WATER-CONDUCTING DOMESTIC APPLIANCE

(71) Applicant: BSH Hausgeräte GmbH, Munich (DE)

(72) Inventor: Karlheinz Rehm, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 291 days.

(21) Appl. No.: 15/897,187

(22) Filed: Feb. 15, 2018

(65) Prior Publication Data

US 2018/0249882 A1 Sep. 6, 2018

(30) Foreign Application Priority Data

Mar. 2, 2017 (DE) ..... 10 2017 203 416

(51) Int. Cl.
*A47L 15/00* (2006.01)
*A47L 15/42* (2006.01)
*A47L 15/48* (2006.01)

(52) U.S. Cl.
CPC ..... *A47L 15/0034* (2013.01); *A47L 15/0084* (2013.01); *A47L 15/4209* (2016.11); *A47L 15/4223* (2013.01); *A47L 15/4225* (2013.01); *A47L 15/4291* (2013.01); *A47L 15/483* (2013.01); *A47L 15/486* (2013.01); *A47L 15/4214* (2013.01); *A47L 15/4246* (2013.01); *A47L 2601/20* (2013.01)

(58) Field of Classification Search
CPC ..... A47L 15/0034; A47L 15/4209; A47L 15/0084; A47L 15/4223; A47L 15/4225; A47L 15/4291; A47L 15/483; A47L 15/486; A47L 15/4214; A47L 15/4246; A47L 2601/20
USPC ..... 134/58 D
See application file for complete search history.

(56) References Cited

U.S. PATENT DOCUMENTS 3,006,979 A * 10/1961 Rich ..... H01L 35/30 136/204
2018/0028042 A1 2/2018 Heinle et al.

FOREIGN PATENT DOCUMENTS

| | | | | |
|---|---|---|---|---|
| DE | 19758061 A1 | 7/1999 | | |
| DE | 102013002116 A1 | 8/2014 | | |
| DE | 102015203532 A1 * | 9/2016 | ..... | A47L 15/4291 |
| EP | 0771898 A2 * | 5/1997 | ..... | D06F 39/006 |
| WO | WO-2016036568 A1 * | 3/2016 | ..... | A47L 15/4217 |

OTHER PUBLICATIONS

DE19758061C2—Machine translation (Year: 1999).*
DE102015203532A1—Machine translation (Year: 2016).*

* cited by examiner

*Primary Examiner* — Tinsae B Ayalew
(74) *Attorney, Agent, or Firm* — Michael E. Tschupp; Andre Pallapies; Brandon G. Braun

(57) ABSTRACT

A water-conducting domestic appliance, in particular a dishwasher, includes a wash container for holding items being washed, a first container and a second container for holding water. A a thermal insulation is arranged between the first container and the wash container. The second container is arranged in thermal contact with the wash container. A decanting device is provided for transferring the water from the first container into the second container to dry the items being washed.

21 Claims, 4 Drawing Sheets

WATER-CONDUCTING DOMESTIC APPLIANCE AND METHOD FOR OPERATING A WATER-CONDUCTING DOMESTIC APPLIANCE

CROSS-REFERENCES TO RELATED APPLICATIONS

This application claims the priorities of German Patent Application, Serial No. 10 2017 203 416.5, filed Mar. 2, 2017, pursuant to 35 U.S.C. 119(a)-(d), the disclosure of which is incorporated herein by reference in its entirety as if fully set forth herein.

BACKGROUND OF THE INVENTION

The present invention relates to a water-conducting domestic appliance as well as a method for operating a water-conducting domestic appliance.

Conventional dishwashers have a container configured as a heat exchanger, which is mounted for example on one side of the dishwasher. The container can be filled with water from the connected water conduit. DE 10 2013 002 116 A1 describes a dishwasher with an inflowing water storage unit. The inflowing water storage unit is filled with cold fresh water after a wash cycle for example. The water can heat up to ambient temperature before the next wash cycle. This water, which is then warmer than the fresh water, can be used for the next wash cycle, with the result that less energy is required to heat the water.

Such a container can also be used to cool an inner face of the wash container after the end of the wash cycle, thereby bringing about condensation of the moisture in the air in the wash container on said inner face due to the temperature difference. This causes moisture to be extracted from the air in the wash container, so that the items being washed in the wash container can dry more quickly. Drying in this manner is particularly energy-saving.

In some countries, for example the USA, provision is made however for dishwashers to be connected to a warm water conduit. The water then frequently has a temperature of around 60° C. This means that the water is at a similar temperature to the items being washed or the air in the wash container, after a wash cycle has been completed. The described method is therefore not used in such countries.

SUMMARY OF THE INVENTION

Against this background it is one object of the present invention to create an improved water-conducting domestic appliance.

According to a first aspect a water-conducting domestic appliance, in particular a dishwasher, is proposed, with a wash container for holding items being washed, a first container and a second container for holding water. Arranged between the first container and the wash container is a thermal insulation, the second container is arranged in thermal contact with the wash container, and a decanting device is provided to transfer the water from the first container into the second container to dry the items being washed.

This water-conducting domestic appliance advantageously allows a store of cold water to be available, even if the water-conducting domestic appliance only has one warm water connection.

Filling the first container with water allows the water temperature to adjust to ambient temperature. To this end the first container is in thermal contact with its surroundings. For example at least part of the first container is made of a metal with a good thermal conductivity. After a certain cooling period, which is a function of the degree of temperature difference between the surroundings and the first container, as well as the efficiency of the exchange of heat with the surroundings, the first container and the water therein are roughly at ambient temperature, for example around 20° C.-25° C.

The thermal insulation, which is configured for example as a polymer foam and conducts very little or no heat at all, thermally insulates the first container from the wash container. This ensures that the water in the first container does not heat up when a wash cycle is performed with hot water, which can reach up to 90° C.

In contrast the second container is in thermal contact with the wash container. Thermal contact here means in particular that at least part of the wash container is at roughly the same temperature as the second container. For example at least part of the second container is made of a heat-conducting metal, at least part of the wash container also being made of heat-conducting metal, and these two metal parts being in thermal contact. Heat can then be transferred from one to the other.

The efficiency of such heat conducting is in particular a function of the specific thermal conductivity of the materials forming the thermal contact as well as the size of the contact surface. The specific thermal conductivity is given for example in watts per meter and Kelvin. Thermal contact can be characterized for example by transferrable power per unit of time and temperature difference. Metals for example have a specific thermal conductivity of more than 40 W/mK. Very good thermal conductors include copper and silver with a specific thermal conductivity of more than 400 W/mK.

After the end of a wash cycle, when the water, which has cooled to ambient temperature, is decanted from the first container into the second container, for example using a pump, the part of the wash container in thermal contact with the second container is cooled. The part of the wash container cooled in this process is preferably a side wall of the wash container. Water from the warm and moist air in the wash container can then condense on an inner face of this side wall. This causes moisture to be extracted from the air in the wash container, allowing it to absorb moisture again. This aids the evaporation of washing water remaining on the items being washed, thus accelerating the drying of the items being washed.

The water-conducting domestic appliance is for example a dishwasher, in particular a domestic dishwasher.

According to one embodiment of the water-conducting domestic appliance the decanting device to transfer the water from the first container into the second container can be configured as a valve, pump and/or siphon pump.

The first container can advantageously be arranged in such a manner that gravity is sufficient to decant the water into the second container. It is then sufficient to arrange a conduit with a corresponding valve between the first container and the second container and to open the valve to decant the water.

It is also possible to deploy pumps already present, for example a circulating pump of the water-conducting domestic appliance, for decanting. There is then no need for an additional pump.

According to a further embodiment of the water-conducting domestic appliance the second container can be arranged in surface contact with a side wall of the wash container.

Surface contact here means in particular that the contact surface, by way of which heat can be transferred, comprises for example at least 10 $cm^2$. Surface contact can also be specified in relation to the surface of the side wall, for example surface contact should amount to at least 10% of this surface.

This embodiment has the advantage that a surface temperature of the inward facing surface of the side wall corresponds to the temperature of the water in the second container. This means in particular that there is not a large temperature difference between the temperature of the water in the second container and the temperature of the inner face. For example a temperature difference is maximum 5° C., maximum 10° C. or maximum 20° C. When determining this temperature difference a certain equalization time should be taken into account, which is a function in particular of the thermal contact. It can take five minutes for example for the temperatures to have equalized, or even ten minutes.

Surface contact can be achieved with a number of smaller contact points. Provision can be made for example for 20 bearing points each with a one square centimeter contact surface to be distributed over the side surface. If these bearing points are made of a material with very good heat conductivity, for example copper, good thermal contact is ensured.

According to a further embodiment of the water-conducting domestic appliance at least part of the first container and/or the second container is configured from a material with a specific thermal conductivity of at least 40 W/mK, preferably at least 80 W/mK, even more preferably at least 150 W/mK.

According to a further embodiment of the water-conducting domestic appliance the first container and/or the second container has/have an internal structure that enlarges an inner surface.

Cooling ribs pointing inward for example are provided. This advantageously allows all the thermal capacity of the water to be used for cooling without actively mixing the water in the second container.

Water is a poor heat conductor with a specific thermal conductivity of around 0.5 W/mK, so this measure can improve the effectiveness of the cooling effect.

According to a further embodiment of the water-conducting domestic appliance the first container and the second container have the same volume.

The same volume here means an identical volume or essentially the same volume with up to 20% difference.

According to a further embodiment of the water-conducting domestic appliance the first container and the second container each have a volume in the region of 2.5-3.0 liters.

This quantity of water offers sufficient thermal capacity to aid efficient drying of the items being washed.

According to a further embodiment of the water-conducting domestic appliance the thermal insulation can be configured as an air layer, a vacuum chamber, a fleece and/or a polymer foam layer.

According to a further embodiment of the water-conducting domestic appliance the thermal insulation can have a coating for reflecting heat radiation.

Such a coating can be configured for example as a mirror with a reflective layer made of aluminum or silver.

According to a further embodiment of the water-conducting domestic appliance the first container can have a heat exchanging means for allowing exchange of heat with its surroundings.

Such a heat exchanging means can be configured for example by a side wall of the container made of a material with good thermal conductivity, for example metal. The more efficient the exchange of heat with the surroundings, the faster the water in the first container cools and the sooner a drying cycle can be accelerated with cooled water.

According to a further embodiment of the water-conducting domestic appliance the heat exchanging means for exchanging heat with the surroundings can be configured as a cooling element.

Such a cooling element offers a particularly efficient exchange of heat with its surroundings. Further measures are expedient, depending on how the water-conducting domestic appliance is fitted. In the case of a built-in dishwasher for example an air slot or back ventilation can be provided, allowing a certain exchange of air with the air in the room. A fan can also be provided to assist, circulating the air actively to achieve faster cooling.

According to a further embodiment of the water-conducting domestic appliance the thermal contact between the second container and the wash container can be configured as a heat-conducting means.

The heat-conducting means in particular has a particularly high specific thermal conductivity. However the heat-conducting means can also have a more complex structure. For example what is known as a heat pipe can be provided to form the thermal contact. This allows different requirements to be met with regard to installation, which are not possible for example with surface contact.

For example the second container is arranged below the wash container, because there is unused space there. To cool the side surface of the wash container, a heat pipe transfers the heat from the side wall to the second container, thereby cooling the side wall.

According to a further embodiment of the water-conducting domestic appliance a blower can be provided to circulate the air in the wash container.

Such a blower is configured as a fan for example. The blower assists the drying of the items being washed, in that dry air produced on the cool side wall of the wash container comes into contact with the still wet items being washed more quickly and is also guided back onto the side wall again more quickly after absorbing moisture.

According to a further embodiment of the water-conducting domestic appliance the water-conducting domestic appliance only has one warm water connection.

According to a second aspect a method for operating a water-conducting domestic appliance, in particular a dishwasher, is proposed. The water-conducting domestic appliance has a wash container for holding items being washed, a first container and a second container for holding water. Arranged between the first container and the wash container is a thermal insulation and the second container is arranged in thermal contact with the wash container. A decanting device for decanting the water from the first container into the second container is also provided. In a first step the first container is filled with warm water. In a second step the water in the first container is cooled to ambient temperature. In a third step a wash cycle is performed. In a fourth step the water, which has been cooled to ambient temperature, is decanted from the first container into the second container, in order to dry the items being washed.

This method advantageously allows such drying assistance also to be applied when the dishwasher is operated with warm water or only has one warm water connection.

According to one embodiment of the method the first container is refilled with warm or hot water, as soon as the cool water has been decanted into the second container.

For example the first container is refilled with warm water from the warm water conduit directly after a wash cycle, when the cold water has been decanted from the first container into the second container. The warm water starts to cool immediately in the first container. This keeps the time interval short between two wash cycles that end with the drying of the items being washed.

According to a further embodiment of the method the water is only decanted from the first container into the second container, if a predefined maximum temperature of the water in the first container is not exceeded.

A computer program product is also proposed, which causes the method set out above to be performed on a program-controlled facility.

A computer program product, for example a computer program means, can be provided or supplied for example as a storage medium, for example a memory card, USB stick, CD-ROM, DVD, or even in the form of a downloadable file from a server in a network.

This can be done for example in a wireless communication network by transferring a corresponding file containing the computer program product or the computer program means.

The embodiments and features described for the proposed domestic appliance apply correspondingly to the proposed method.

Further possible implementations of the invention comprise combinations, which may not be specifically cited, of features or embodiments described above or in the following in relation to the exemplary embodiments. The person skilled in the art will also add individual aspects to improve or supplement the respective basic form of the invention.

BRIEF DESCRIPTION OF THE DRAWING

Further advantageous configurations and aspects of the invention are the subject matter of the subclaims and the exemplary embodiments of the invention described in the following. The invention is described in more detail below based on preferred embodiments with reference to the accompanying figures.

DETAILED DESCRIPTION OF PREFERRED EMBODIMENTS

Figure 1:
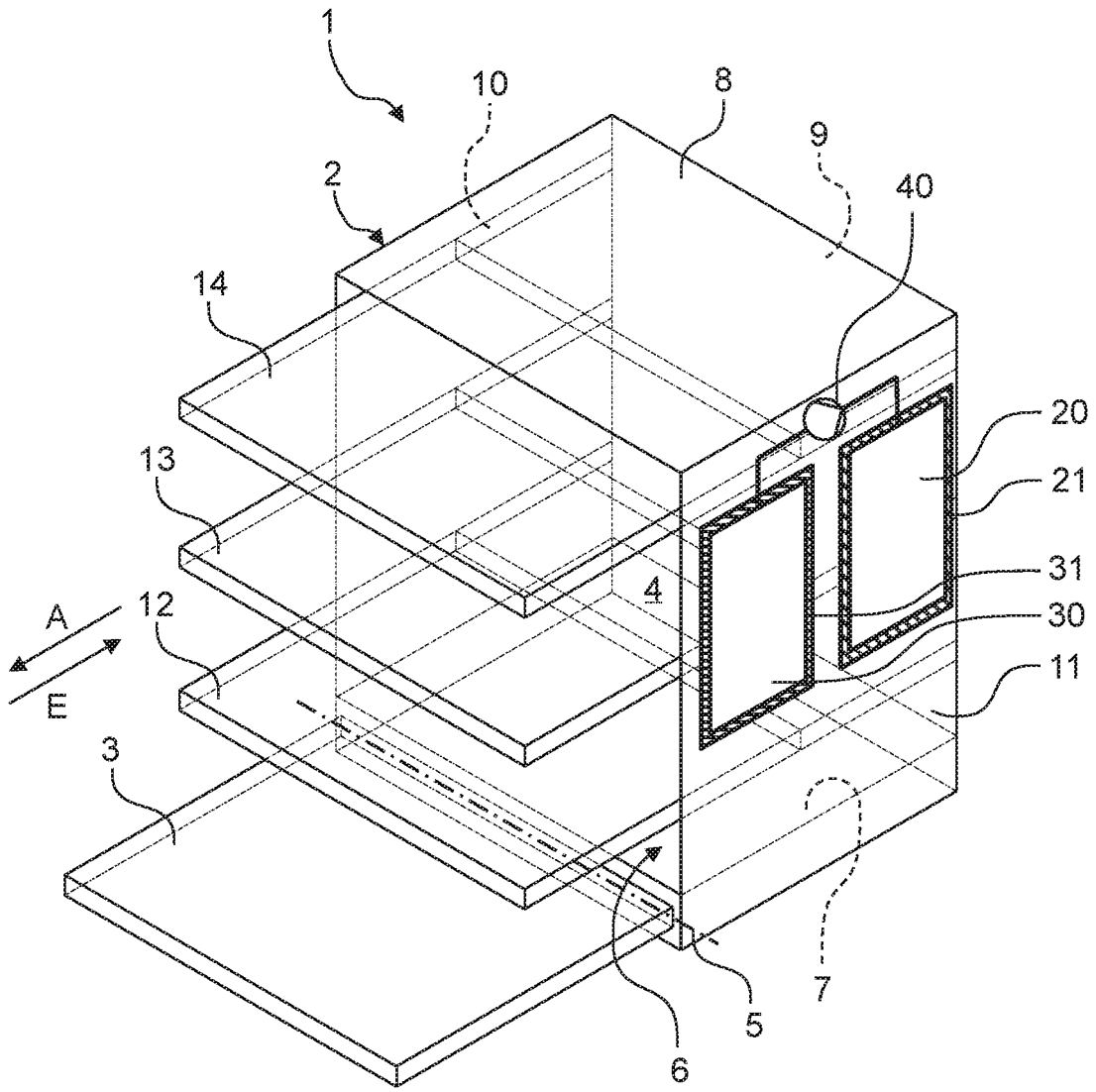
FIG. 1 shows a schematic perspective view of an embodiment of a domestic dishwasher.

Unless otherwise specified, identical elements or those of identical function are shown with the same reference characters in the figures.

FIG. 1 shows a schematic perspective view of an embodiment of a domestic dishwasher 1 as an example of a water-conducting domestic appliance. The domestic dishwasher 1 comprises a wash container 2, which can be closed, in particular in a water-tight manner, by a door 3. To this end a sealing facility can be provided between the door and the wash container 2. The wash container 2 is preferably box-shaped. The wash container 2 can be arranged in a housing of the domestic dishwasher 1. The wash container 2 and door 3 can form a wash chamber 4 for washing items being washed.

The door 3 is shown in its opened position in FIG. 1. The door 3 can be closed or opened by pivoting about a pivot axis 5 provided at a lower end of the door 3. The door 3 can be used to close or open a loading opening 6 of the wash container 2. The wash container 2 has a base 7, a top 8 arranged opposite the base 7, a rear wall 9 arranged opposite the closed door 3 and two side walls 10, 11 arranged opposite one another. The base 7, top 8, rear wall 9 and side walls 10, 11 can be made of stainless steel sheet for example. Alternatively the base 7 for example can be made of a plastic material.

A first container 20 and a second container 30 are arranged on the side wall 11. Also arranged between the first container 20 and the side wall 11 is a thermal insulation layer 21, which in the present instance is configured as a 1 cm thick polyurethane layer. In contrast the second container 30 is arranged in thermal contact 31 with the side wall 11. To this end the second container 30 has a metal part, which is in surface contact with the side wall 11. The first container 20 is also connected to the second container 30 by way of a conduit, with a pump 40 connected in between. This conduit and the pump 40 allow water to be decanted from the first container 20 into the second container 30. The pump 40 is thus an example of a decanting device. When cold water is decanted from the first container 20 into the second container 30 at the end of a wash cycle, said water cools the inner face of the side wall 11 by way of the thermal contact 31. Moisture from the warm and moist air in the wash container 2 then condenses on the cool inner face. This allows the air to absorb moisture again, thereby accelerating a drying cycle for the items being washed.

The domestic dishwasher 1 also has at least one holder 12 to 14 for items being washed. A number, for example three, of holders 12 to 14 for items being washed can preferably be provided, it being possible for the holder 12 for items being washed to be a lower holder or lower rack, the holder 13 for items being washed to be an upper holder or upper rack and the holder 14 for items being washed to be a flatware drawer. As also shown in FIG. 1, the holders 12 to 14 for items being washed are arranged one above the other in the wash container 2. Each holder 12 to 14 for items being washed can be moved as required into the wash container 2 or out of it. In particular each holder 12 to 14 for items being washed can be pushed into the wash container 2 in an insertion direction E and be pulled out of the wash container 2 counter to the insertion direction E in a removal direction A.

Figure 2:
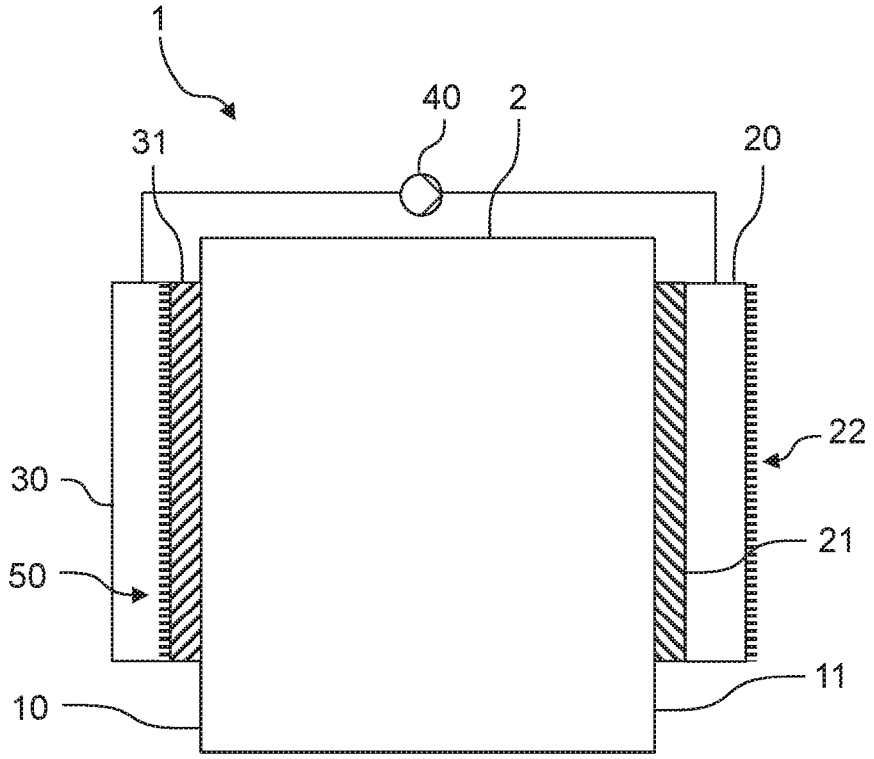
FIG. 2 shows a schematic section through an exemplary embodiment of a water-conducting domestic appliance.

FIG. 2 shows a schematic section through an exemplary embodiment of a water-conducting domestic appliance 1, only the essential details being shown in FIG. 2. The water-conducting domestic appliance 1 has a wash container 2, which in the present instance is made of stainless steel sheet. Arranged on the right side wall 11 of the wash container 2 is a first container 20, with a thermal insulation layer 21, in the present instance configured as a vacuum insulation plate, arranged between the side wall 11 and the first container 20. The first container 20 is also made of stainless steel sheet and has a volume of 3 l. Arranged on the outward-facing side of the first container 20 is a heat exchanger 22, in the present instance configured as an aluminum cooling element. This measure significantly accelerates a transfer of heat to the surroundings and warm or hot water in the first container 20 can cool more quickly.

Arranged on the left side wall 10 of the wash container 2 is a second container 30, which is also made of stainless steel sheet and has a volume of 3 l. A thermal contact 31 is configured between the second container 30 and the side wall 10. In the present instance this is configured by a surface contact in the form of a thin aluminum plate. Provision can be made for the thermal contact 31 to be improved by applying a heat-conducting paste, for example containing a portion of silver. The heat-conducting paste equalizes any minor unevenness between the contacting surfaces. The stainless steel sheets of the wash container 2 and the second container 30 are also thinner in the region of the thermal contact 31 than the other parts, as stainless steel has a relatively low specific thermal conductivity. Arranged on the inner face of the second container 30 facing the thermal contact 31 in this exemplary embodiment is an internal structure 50 in the form of aluminum ribs, which improve the transfer of heat to the water in the second container 30.

The first container 20 and the second container 30 are connected to one another by way of a conduit with a pump 40 connected in between. The pump 40 is designed to pump water out of the first container 20 into the second container 30. When cooled water is decanted from the first container 20 into the second container 30 at the end of a wash cycle, said water cools the inner face of the side wall 10 by way of the thermal contact 31. Moisture from the warm and moist air in the wash container 2 then condenses on the cool inner face. This allows the air to absorb moisture again, thereby accelerating a drying cycle for the items being washed.

Figure 3:
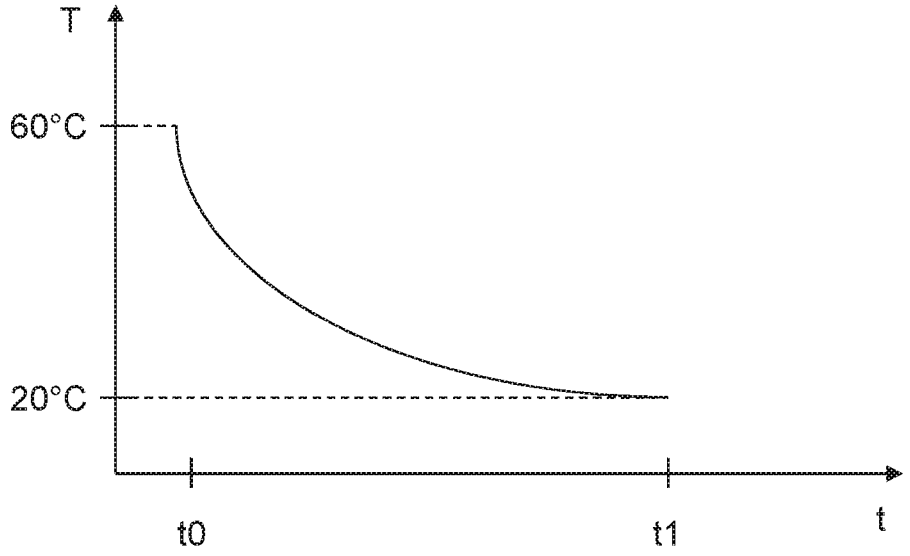
FIG. 3 shows an exemplary diagram of a temperature profile of water in the first container.

FIG. 3 shows an exemplary diagram of a temperature profile of water in the first container 20 (see FIG. 1, 2), said water having been introduced at time point t0 at a temperature of 60° C. The exchange of heat with the surroundings, here at a temperature of 20° C., causes the water to cool slowly. When the temperature difference is large, the cooling process is rapid at first and then loses speed. At time point t1 the water is roughly at the ambient temperature of 20° C.

Figure 4:
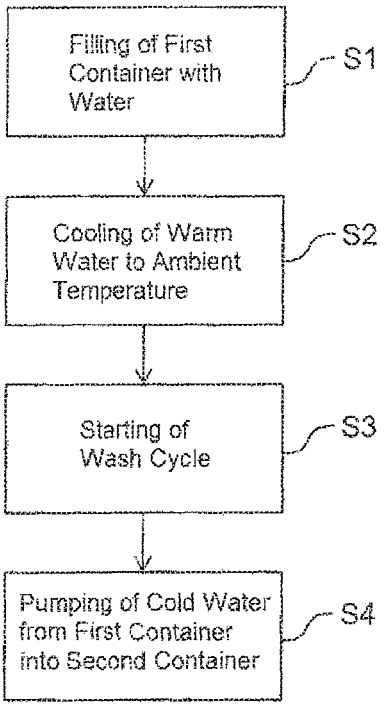
FIG. 4 shows a block diagram of an exemplary method for operating a water-conducting domestic appliance.

FIG. 4 shows a block diagram of an exemplary method for operating a water-conducting domestic appliance 1, for example the domestic dishwasher in FIG. 1. In the first step S1 the first container 20 (see FIG. 1 or FIG. 2) is filled with warm or hot water. In the second step S2 the warm water cools to ambient temperature (see FIG. 3 for example). In the third step S3 a wash cycle is started. As the first container 20 is thermally insulated from the wash container 2 by an insulation layer 21, the water therein remains cold. When the wash cycle reaches the drying step, in the fourth step S4 the cold water is pumped from the first container 20 by way of the pump 40 into the second container 30, which is in thermal contact 31 with a side wall 10, 11 of the wash container 2. The cold water absorbs heat, causing the inner face of the side wall 10, 11 to cool, with the result that moisture from the warm and moist air condenses on the inner face. The condensed moisture then runs down for example. The air is again able to absorb moisture from the still wet items being washed, thereby accelerating the drying of the items being washed.

Although the present invention has been described based on exemplary embodiments, it can be modified in many different ways. For example a temperature sensor can be provided in particular in the first container, to determine the water temperature. It can be decided on this basis whether the drying cycle is accelerated efficiently, as proposed. Circulating pumps can also be provided in the first container and/or the second container, in order to prevent the water mixing and thus heat insulation layers forming in the water.

What is claimed is:

1. A water-conducting domestic appliance, comprising:

a wash container for holding an item to be washed, the wash container having a base, a top, a rear wall, two side walls, and a loading opening closable by a door, with at least one of the two side walls being made of metal;

first and second containers configured to hold water, said second container being made of metal;

a thermal insulation arranged between the first container and the wash container; and a decanting device comprising a circulating pump disposed in a water conduit connecting the first container to the second container and constructed to transfer the water from the first container into the second container to dry the item in the wash container, wherein the second container is arranged in direct metal to metal surface contact with the at least one of the two side walls of the wash container, so as to be in thermal contact with the wash container.

2. The water-conducting domestic appliance of claim 1, constructed in the form of a dishwasher.

3. The water-conducting domestic appliance of claim 1, wherein the decanting device further comprises a valve.

4. The water-conducting domestic appliance of claim 1, wherein at least one of the first and second containers has a part which is configured from a material with a specific thermal conductivity of at least 40 W/mK.

5. The water-conducting domestic appliance of claim 4, wherein the specific thermal conductivity of the part is at least 80 W/mK.

6. The water-conducting domestic appliance of claim 4, wherein the specific thermal conductivity of the part is at least 150 W/mK.

7. The water-conducting domestic appliance of claim 1, wherein at least one member selected from the group consisting of the first container and the second container has an internal structure that enlarges an inner surface of the member.

8. The water-conducting domestic appliance of claim 1, wherein the first container and the second container have a same volume.

9. The water-conducting domestic appliance of claim 1, wherein the first container and the second container have a volume in a region of 2.5-3.0 liters.

10. The water-conducting domestic appliance of claim 1, wherein the thermal insulation is configured as an air layer, a vacuum chamber, a fleece and/or a polymer foam layer.

11. The water-conducting domestic appliance of claim 1, wherein the thermal insulation has a coating for reflecting heat radiation.

12. The water-conducting domestic appliance of claim 1, further comprising a heat exchanging means arranged on the first container for exchange of heat with the surroundings.

13. The water-conducting domestic appliance of claim 12, wherein the heat exchanging means is configured as a cooling element.

14. A water-conducting domestic appliance, comprising:

a wash container for holding an item to be washed, the wash container having a base, a top, a rear wall, two side walls, and a loading opening closable by a door, with at least one of the two side walls being made of metal;

first and second containers configured to hold water, said second container being made of metal;

a thermal insulation arranged between the first container and the wash container;

a decanting device constructed to transfer the water from the first container into the second container to dry the item in the wash container; and an aluminum plate disposed between the second container and the at least one of the two side walls of the wash container and configured to establish thermal contact between the second container and the wash container.

15. The water-conducting domestic appliance of claim 1, further comprising a blower configured to circulate air in the wash container.

16. The water-conducting domestic appliance of claim 1, further comprising a single warm water connection only, for supply of water.

17. A method for operating a water-conducting domestic appliance, in particular a dishwasher, said method comprising:

filling a first container, which is insulated from a wash container for holding an item to be washed, with warm water, the wash container including at least one side wall formed of metal;

cooling the water in the first container to ambient temperature;

performing a wash cycle; and decanting the water, cooled to ambient temperature in the first container, from the first container into a second container which is made of metal and which is in direct metal to metal surface contact with the at least one side wall of the wash container, so as to be in thermal contact with the wash container, to dry the item in the wash container, wherein the decanting is performed by a circulating pump disposed in a water conduit connecting the first container to the second container.

18. The method of claim 17, wherein the at least one side wall of the wash container and the second container are made of stainless steel sheet.

19. A water-conducting domestic appliance, comprising:

a wash container for holding an item to be washed, the wash container having a base, a top, a rear wall, two side walls, and a loading opening closable by a door, with at least one of the two side walls being made of metal;

first and second containers configured to hold water, said second container being made of metal;

a thermal insulation arranged between the first container and the wash container; and a decanting device constructed to transfer the water from the first container into the second container to dry the item in the wash container, wherein the second container is arranged in metal to metal surface contact with the at least one of the two side walls of the wash container, so as to be in thermal contact with the wash container, wherein the at least one of the two side walls of the wash container and the second container are made of stainless steel sheet, and wherein the stainless steel sheet of the at least one of the two side walls of the wash container and of the second container is thinner in a region of thermal contact as compared to other portions of the wash container and the second container.

20. The water-conducting domestic appliance of claim 14, further comprising a heat-conducting paste applied to the aluminum plate.

21. A water-conducting domestic appliance, comprising:

a single warm water connection only, for supply of warm water;

a wash container for holding an item to be washed;

first and second containers configured to hold water, said second container being arranged in thermal contact with the wash container;

a thermal insulation arranged between the first container and the wash container, the first container initially being filled with warm water from the single warm water connection, the warm water cooling to ambient temperature to provide cooled water prior to a start of a wash cycle; and a decanting device comprising a circulating pump and constructed to transfer the cooled water from the first container into the second container, wherein the first container and the second container are connected to one another by a water conduit with the circulating pump connected in between, with the circulating pump being configured to pump the cooled water out of the first container into the second container, such that on condition that the cooled water is pumped from the first container into the second container at an end of the wash cycle, said cooled water cools an inner face of the wash container by way of the thermal contact, and moisture from warm and moist air in the wash container then condenses on the cool inner face of the wash container to allow air in the wash container to absorb moisture again, thereby accelerating a drying cycle for the item in the wash container being washed.

* * * * *